US005482172A

United States Patent [19]

Braddock

[11] Patent Number: 5,482,172

[45] Date of Patent: Jan. 9, 1996

[54] CONTAINER WITH DUAL DISPENSERS

[76] Inventor: C. Calvin Braddock, P.O. Box 6636, Shreveport, La. 71136

[21] Appl. No.: 123,758

[22] Filed: Sep. 16, 1993

[51] Int. Cl.[6] ..... B65D 47/08

[52] U.S. Cl. ..... 215/235; 215/237; 220/254; 220/339; 222/534

[58] Field of Search ..... 215/6, 235, 237; 220/339, 524, 254; 222/534, 535

[56] References Cited

U.S. PATENT DOCUMENTS

| | | | |
|---|---|---|---|
| D. 85,894 | 12/1931 | Tappan . | |
| D. 315,096 | 3/1991 | Rocchio . | |
| 1,660,606 | 2/1928 | Evans . | |
| 1,831,290 | 11/1931 | Daniel . | |
| 4,607,756 | 8/1986 | Courtman | 215/6 |
| 4,993,606 | 2/1991 | Bolen, Jr. et al. | 215/235 X |
| 5,123,561 | 6/1992 | Gross | 220/254 |
| 5,188,253 | 1/1992 | Poore et al. . | |
| 5,236,107 | 8/1993 | Spaanstra, Sr. | 220/254 X |
| 5,252,312 | 10/1993 | Gentile et al. | 215/6 X |

FOREIGN PATENT DOCUMENTS

| | | | |
|---|---|---|---|
| 623304 | 7/1961 | Canada | 215/2 |
| 1178347 | 5/1959 | France | 215/2 |
| 1222712 | 6/1960 | France | 215/2 |
| 876295 | 5/1953 | Germany | 215/2 |
| 971029 | 9/1964 | United Kingdom | 222/534 |

*Primary Examiner*—Jes F. Pascua
*Attorney, Agent, or Firm*—John M. Harrison

[57] ABSTRACT

A container with dual dispensers for allowing easy and complete dispensing of the container contents from either end of the container. In a first embodiment the container is characterized by a receptacle provided with a top dispenser on the upper end and a bottom dispenser on the lower end. The dispensers each include a pivoting lid or spout which reversibly seals a dispensing hole provided on the corresponding top or bottom surface of the container. In a second embodiment the top dispenser is characterized by a pivoting lid hinged at substantially the midpoint of the container top surface. In a third embodiment the top dispenser includes a spout pivoted to the top surface of the container and in a fourth embodiment the top dispenser is characterized by a threadably-mounted closure which pivotally carries a lid for reversibly sealing a dispensing hole in the top surface of the closure. In another embodiment the container is provided with both top and bottom dispensers, each having a pivoting lid which is recessed in the corresponding end of the container and is pivoted open into dispensing configuration by applying pressure to one end of the lid.

3 Claims, 2 Drawing Sheets

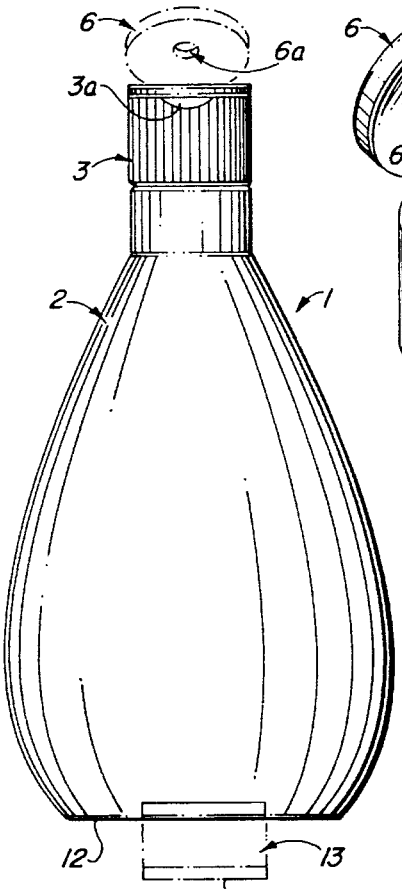
FIG. 7
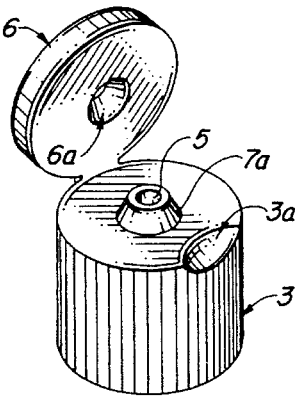
FIG. 8A
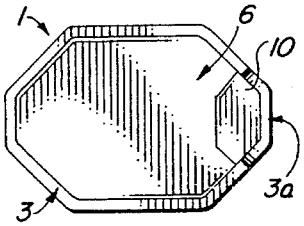
FIG. 10A
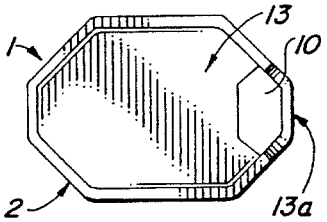
FIG. 10B
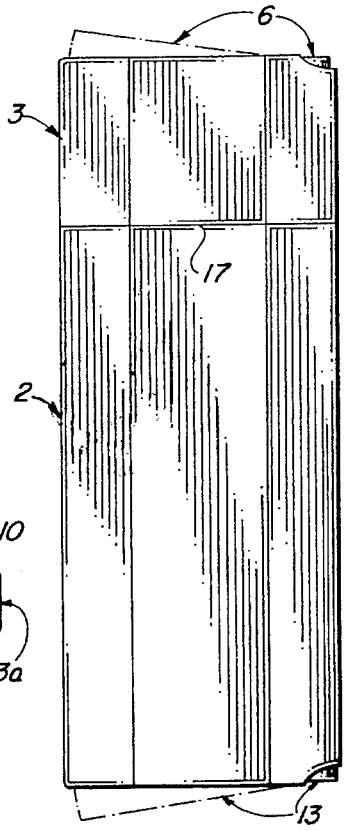
FIG. 9
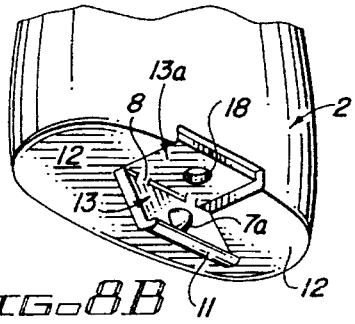
FIG. 8B
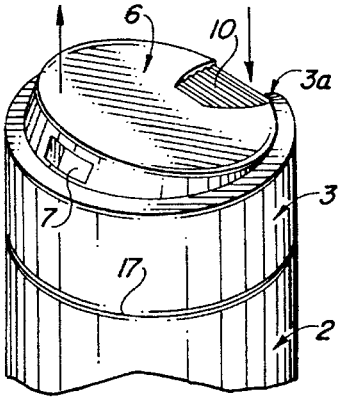
FIG. 12
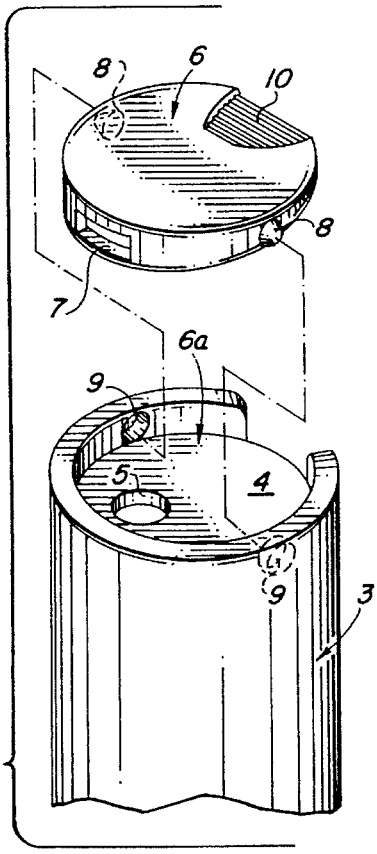
FIG. 13
FIG. 11
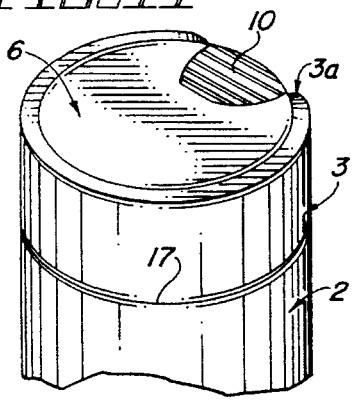

CONTAINER WITH DUAL DISPENSERS

BACKGROUND OF THE INVENTION

1. Field of the Invention

This invention relates to containers and receptacles for dispensing materials such as toothpaste, hand cream, liquid soap and the like, and more particularly, to a container with a dispenser at each end for easily and completely dispensing the container contents from either end of the container. In a first embodiment the container with dual dispensers of this invention includes an elongated, rectangular container, provided on the upper end with a top dispenser mounted on a rectangular closure, the rear upper edge of which closure hingedly carries a lid for reversibly sealing a dispensing opening provided on the top surface of the closure by means of a flange which is provided on the bottom surface of the lid and registers with and seals the dispensing opening when the lid is in the closed position. A bottom dispenser of the same construction and configuration is provided on the lower end of the container. In a second embodiment the top and bottom dispensers each include a pivoting lid which is hinged to substantially the midpoint of the closure top and container bottom surface, respectfully, and reversibly seals a dispensing hole provided in the closure and bottom surface. In a third embodiment a tubular container is provided on the upper end with a top dispenser characterized by a cylindrical closure, which closure and bottom each pivotally carries a dispensing spout and accommodates the spout in a recess when the spout is in the closed position. In a fourth embodiment a flask-shaped container is provided with a top dispenser in a cylindrical cap or closure which is threadably mounted on the upper end of the container and pivotally carries a circular lid for reversibly sealing a dispensing opening in the top surface of the closure. A recessed bottom dispenser having the design illustrated in FIG. 2, is provided on the bottom of the container. In a fifth embodiment of the invention an elongated, cylindrical or hexagonally-shaped container is provided with a top dispenser having a cylindrical or hexagonal closure which is mounted on the upper end of the container and receives a hinged recessed lid which is pivoted open to dispense the container contents by applying pressure to a depression provided on one end of the lid. A bottom dispenser of identical construction is provided on the lower end of the container.

One of the problems encountered in conventional flexible plastic containers which are used to dispense materials such as toothpaste, liquid soap, hand cream, cosmetics and the like, is the difficulty of completely emptying a container with a single dispenser. Often, a container such as a toothpaste cylinder is rolled or folded in an attempt to expel residual toothpaste from the container and this sometimes results in cracking and breaking of the container, causing loss of some of the toothpaste. Description of the Prior Art Various containers having two openings have been devised for storing and dispensing the contents. U.S. Pat. No. 1,660,606, dated Feb. 28, 1928, to K. Evans, describes a "Milk Bottle With Open Bottom" characterized by a milk bottle provided with threads on the interior surface of the side wall. A bottle bottom has threads around the circumferential edge and removal of the bottom permits thorough cleansing of the bottle interior. U.S. Pat. No. 1,831,290, dated Nov. 10, 1931, to C. E. Daniel, discloses a "Receptacle" for holding paint, characterized by a cylindrical, hollow body which removably secures a lid on the upper end. The lower end of the body includes a wire mesh which spans the opening and strains the paint as it is dispensed. U.S. Design Pat. No. 85,894, dated Dec. 29, 1931, to Dewitt Tappan, describes and illustrates a dually threaded open-ended "Jar". U.S. Design Pat. No. 315,096, dated Mar. 5, 1991, to Chris A. Rocchio, describes and illustrates a "Gravity Feed Bottle" having dual threaded closures. U.S. Pat. No. 5,188,253, dated Feb. 23, 1993, to Poore, et al., details a "Container and Method of Manufacturing the Same", characterized by a container including a cylindrical casing having a tapered closure at one end, which removably seals a lid. A product is poured into the opposite, open end of the casing and a ring-shaped bottom piece is secured to the casing by rotation-friction welding. A round bottom engages the bottom piece and seals the casing.

It is an object of this invention to provide a container of suitable shape, size and material of construction characterized by a pivoting dispenser on each end, for selectively allowing easy and complete emptying of the container contents by operation of either dispenser.

It is another object of this invention to provide a container with dual dispensers, characterized by a receptacle having a top dispenser pivoting lid for reversibly sealing a dispensing hole provided in the top surface of the container, the container also provided with a bottom dispenser pivoting lid which is hingedly connected to the bottom surface of the container and reversibly seals a like dispensing opening-provided in the container bottom.

Still another object of this invention is to provide a preferably flexible container having a top dispenser provided on the upper end and a bottom dispenser provided on the lower end of the container, which top dispenser is mounted on a closure on the container and includes a hollow dispensing spout, which is accommodated within a recess provided in the top surface of the closure when not in use, but is pivoted to an extended configuration for dispensing container contents, and which bottom dispenser is characterized by a pivoting lid hingedly connected to a recess in the bottom surface of the container and adapted for reversibly sealing a dispensing hole provided in the bottom of the container.

A still further object of this invention is to provide a container with top and bottom dispenser lids, which top dispenser lid is pivoted on a closure mounted on the upper end of a container and is provided with a lid flange on the bottom surface thereof, for reversibly engaging and sealing a dispensing opening contained in the top surface of the closure, and which bottom dispenser lid is hinged to the bottom surface of the container and includes a lid flange provided on the top surface of the lid, for reversibly engaging and sealing a dispensing opening contained in the bottom surface of the container.

Yet another object of the invention is to provide a container with dual dispensers of suitable shape and size and having a top dispenser lid pivotally mounted on a cylindrical closure or cap threadably mounted on the upper end of the container for reversibly engaging and sealing a dispensing opening included in the top of the closure, and which bottom dispenser lid is hingedly connected to, and recessed in the flat bottom surface of the container and includes a flange provided on the top surface of the lid, for reversibly engaging and sealing a dispensing hole provided in the bottom surface of the container.

Another object of the invention is to provide a preferably flexible container with dual dispensers, including a top dispenser and a bottom dispenser, which top dispenser is hingedly connected to a recess provided in a closure mounted on the upper end of the container, such that pressure applied at one end of the top dispenser pivots the top dispenser to uncover a dispensing hole provided in the closure and unseals a corresponding dispensing slot provided in the side of the pivoting top dispenser and communicating with the dispensing hole, for dispensing the container contents and which bottom dispenser is characterized by the same features and construction as the top dispenser.

SUMMARY OF THE INVENTION

These and other objects of the invention are provided in a flexible plastic container with dispensers at the top and bottom, which dispensers include a top dispenser and a bottom dispenser, the top dispenser of which, in a first embodiment, is attached to a flat closure mounted on the upper end of the container and includes a pivoting lid hinged to the rear top edge of the closure and having a circular flange provided on the bottom surface of the lid, for reversibly engaging and sealing a dispensing opening contained in the top surface of the closure. The first embodiment bottom dispenser includes a pivoting lid which is hinged to the flat bottom surface of the container and includes a circular flange provided on the top surface of the lid, for reversibly engaging and sealing a dispensing opening contained in the bottom surface of the container. In a second embodiment the container includes a similarly-mounted closure provided with a top dispenser characterized by a pivoting lid which is hingedly connected to the top surface of the closure and includes a circular flange provided on the bottom surface of the lid for reversibly engaging and sealing a dispensing opening contained in the top surface of the closure and which bottom dispenser is typically characterized by identical features or by the same features as the bottom dispenser of the first embodiment described above. In a third embodiment the top dispenser is mounted on a closure on the container and includes a pivoting, hollow spout which is hingedly connected to the top surface of the closure and is contained in a recess provided on the top surface of the closure when not in use, but is pivoted into an extended configuration for dispensing the container contents, and which bottom dispenser is typically characterized by the identical features or by same features as the bottom dispenser of the first embodiment described above. In a fourth embodiment a cylindrical closure or cap is threadably mounted on the container and hingedly carries a lid for reversibly engaging and sealing a dispensing opening provided in the top surface of the closure in a manner identical to that described for the lid of the first embodiment, described above, and which bottom dispenser is typically characterized by the same features as the bottom dispenser of the first embodiment. In a last embodiment of the invention the top dispenser is secured to a closure mounted on the upper end of an octagonal or cylindrical container and the closure includes a dispensing hole seated in a recess, within which a pivoting lid is hinged at the midpoint, such that pressure applied on one end of the lid pivots the lid and allows the container contents to pass through the dispensing hole and subsequently through a dispensing slit contained in the side of the pivoted lid. The bottom dispenser is typically characterized by substantially the same features as the top dispenser or by features outlined in the other embodiments of the invention.

BRIEF DESCRIPTION OF THE DRAWINGS

The .invention will be better understood by reference to the accompanying drawings, wherein:

FIG. 7 is a front view of a threaded closure embodiment of the container with dual dispensers of this invention;

FIG. 8A is a perspective view of the threaded closure or cap element of the container with dual dispensers illustrated in FIG.

FIG. 8B is a bottom perspective view of a typical bottom pivoting lid provided in the bottom of the threaded closure container illustrated in FIG. 7;

FIG. 9 is a front view of an octagonally shaped recessed lid embodiment of the container with dual dispensers of this invention;

FIG. 10A is a top view of the top dispenser of the recessed lid embodiment illustrated in FIG. 9;

FIG. 10B is a bottom view of the bottom dispenser of the recessed lid embodiment illustrated in FIG. 9;

FIG. 11 is a perspective view of the closed top dispenser of an alternative cylindrical recessed lid embodiment of the container with dual dispensers of this invention;

FIG. 12 is a perspective view of the open top dispenser of the cylindrical recessed lid embodiment illustrated in FIG. 11, and;

FIG. 13 is an exploded view of the top dispenser of the cylindrical recessed lid embodiment illustrated in FIGS. 11 and 12.

DESCRIPTION OF THE PREFERRED EMBODIMENTS

Figures 1, 2, 3A, 3B, 4, 5, 6, 6A, 6B:
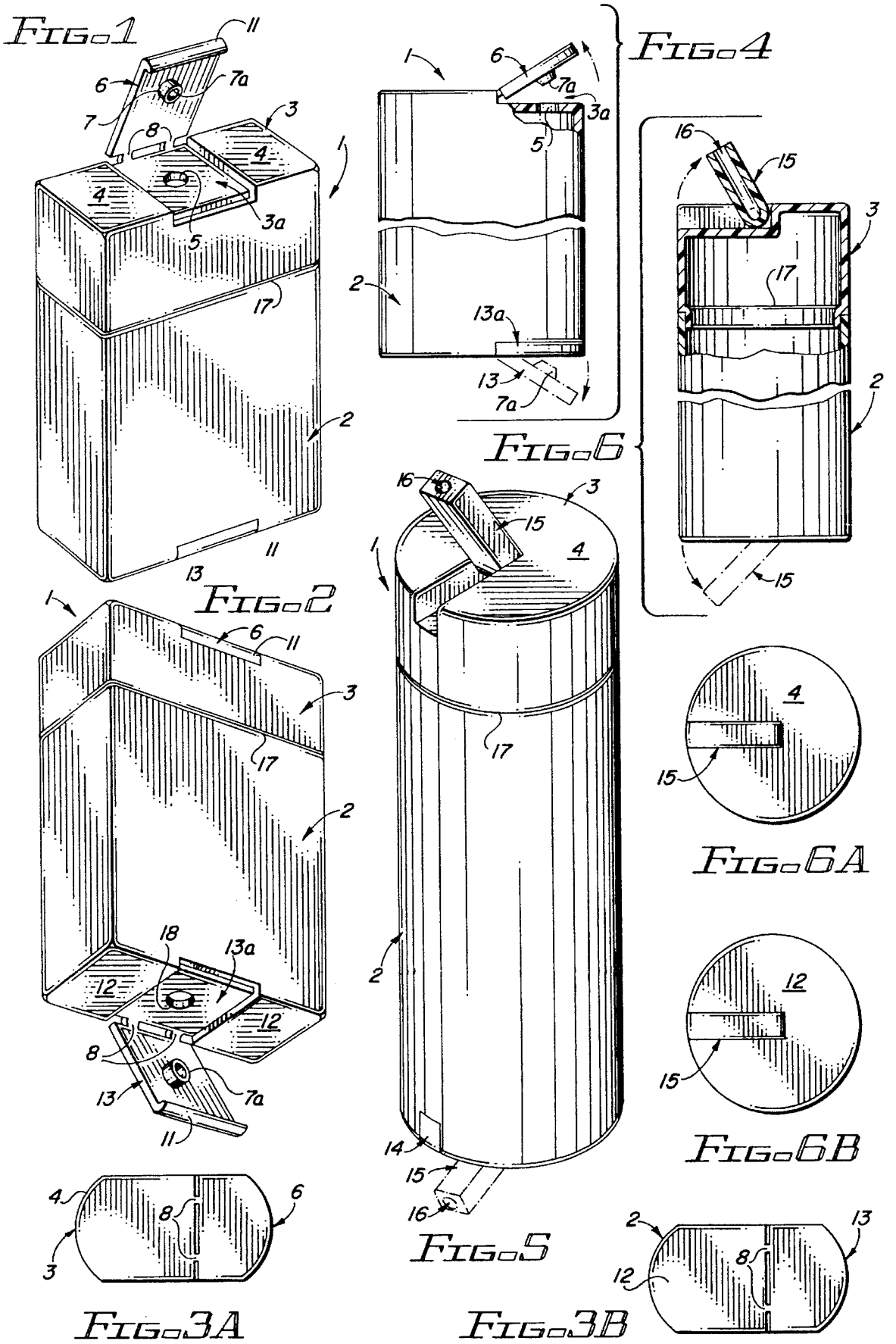
FIG. 1 is a top, perspective view of a first preferred embodiment of the container with dual dispensers of this invention.
FIG. 2 is a bottom perspective view of the embodiment illustrated in FIG. 1.
FIG. 3A is a top view of an alternative pivoting lid embodiment of the container with dual dispensers illustrated in FIG. 1.
FIG. 3B is a bottom view of the alternative pivoting lid embodiment.
FIG. 4 is a side view of the alternative pivoting lid embodiments of the container with dual dispensers of this invention illustrated in FIGS. 3A and 3B.
FIG. 5 is a perspective view of a pivoting spout embodiment of the container with dual dispensers of this invention.
FIG. 6 is a side view of the pivoting spout embodiment of the container with dual dispensers of the invention illustrated in FIGS. 6A and 6B.
FIG. 6A is a top view of the pivoting spout embodiment of the container with dual dispensers illustrated in FIG. 5.
FIG. 6B is a bottom view of the pivoting spout embodiment illustrated in FIG. 5.

Referring intially to FIGS. 1 and 2 of the drawings, a first preferred embodiment of the container with dual dispensers of this invention is generally illustrated by reference numeral 1. The container with dual dispensers 1 includes an elongated, rectangular body portion 2. The body portion 2 includes a rectangular closure 3, which is friction-fitted on the upper end of the body portion 2 at the match line 17 in conventional fashion. The closure 3 includes a closure top 4, the rear edge of which hingedly mounts a top lid 6 by means of lid hinges 8. The geometric center of the top lid 6 is provided with a circular opening flange 7*a*, defining a top lid dispensing opening 7. The front edge of the top lid 6 terminates in a downwardly extending, perpendicular lid flange 11. The closure top 4 includes a closure recess 3*a* which is provided with a closure access opening 5. When the top lid 6 is pivoted into the closed position, it fits snugly into the closure recess 3*a*, as illustrated in FIG. 1, and the opening flange 7*a* registers with and seals the closure access opening 5, preventing inadvertent dispensing of the container contents. The lid flange 11 engages the front edge of the closure top 4 to maintain the top lid 6 in a closed position. The body portion 2 also includes a bottom lid 13, mounted by lid hinges 8, which closes in a bottom recess 13*a*, fitted with a bottom access opening 18 that is closed by an opening flange 7*a*, in the same manner as the top lid 6, described above.

Referring now to FIGS. 3A, 3B and 4 of the drawings, in another embodiment of the invention the body portion 2 is provided with a rectangular closure 3, which is friction-fitted on the corresponding end of the body portion 2, as described above. A top lid 6 is hingedly connected by means of lid hinges 8 to the closure top 4 at a specified distance from the front edge of the closure 3. A closure recess 3*a* accommodates the top lid 6 and an opening flange 7*a*, provided on the bottom surface of the top lid 6, registers with a closure access opening 5 in the closure recess 3*a*, when the top lid 6 is in closed position. Similarly, a bottom lid 13 is hinged by lid hinges 8 to the bottom of the body portion 2 for closure in a bottom recess 13*a*, to seal a corresponding access opening (not illustrated) by means of an opening flange 7*a*.

Referring now to FIGS. 5, 6, 6A and 6B of the drawings, in yet another embodiment of this invention the container with dual dispensers 1 includes a tubular body portion 2. The body portion 2 is provided with top and bottom dispensers, the top dispenser of which is secured to a cylindrical closure 3, friction-fitted on the upper end of the body portion 2 at the match line 17. The closure 3 includes a closure top 4, provided with a spout recess 14. An elongated, substantially rectangular spout 15 is pivotally mounted within the spout recess 14, and includes a central spout bore 16, through which the container contents are dispensed when the spout 15 is extended into the open configuration illustrated in FIG. 5. The spout 15 is pivoted to lie within the spout recess 14 when not in use, as illustrated in FIG. 6A. The body portion 2 also includes a bottom dispensing mechanism which is characterized by the same features; a pivoting spout 15, having spout bore 16, pivoted to and from a bottom recess 13*a*, as illustrated in phantom in FIG. 5 and in FIG. 6B.

Referring next to FIGS. 7, 8A and 8B of the drawings, in yet another embodiment of the invention the container with dual dispensers 1 includes a flask-shaped body portion 2, which typifies the configuration of a conventional salad dressing, liquid soap or hand cream bottle. The body portion 2 includes a top dispenser connected to a cylindrical cap or closure 3 which is threadably mounted on the upper end of the body portion 2, and hingedly carries a top lid 6, that seals a closure access opening 5 when closed, as illustrated in FIG. 8A. A closure recess 3a is provided in the front, upper edge of the closure 3, for lifting the top lid 6 to an open, dispensing position as illustrated in FIG. 8A. The body portion 2 also includes a bottom dispensing mechanism which may be characterized by the same features as the bottom dispenser of the previous embodiments, and includes a bottom recess 13*a*, located in the flat bottom 12 of the body portion 2. A bottom lid 13 is secured to the bottom 12 by means of lid hinges 8 and an opening flange 7*a*, extending from the bottom lid 13, registers with the bottom access opening 18 when the bottom lid 13 is closed on the hinges 8.

Referring now to FIGS. 9–13 of the drawings, in still another embodiment of the invention the container with dual dispensers 1 includes an elongated, hexagonal body portion 2, (FIGS. 9, 10A and 10B) and a cylindrical body portion 2 (FIGS. 11–13). In FIGS. 9, 10A and 10B the body portion 2 is provided with a hexagonal closure 3, which is friction-fitted on the upper end of the body portion 2 at the match line 17. The closure 3 is characterized by a discontinuous wall, defining a closure recess 3*a* at the discontinuity. A recessed closure top 4 is mounted in the closure 3, defining a top lid recess 6*a*, and includes a closure access opening 5 disposed near one edge, as illustrated in FIG. 13. A top lid 6, characterized by a circular wall and a top surface with a lid depression 10, is pivotally mounted in the top lid recess 6*a* by means of two diametrically-opposed lid hinges 8, provided on the top lid 6 and pivotally engaging two corresponding, diametrically-opposed hinge receptacles 9, provided on the closure 3. The wall of the top lid 6 includes a rectangular top lid dispensing opening 7, which is positioned adjacent to the closure access opening 5 and abuts the wall of the closure 3 when the top lid 6 is pivoted to the closed position, as illustrated in FIG. 11. The top lid 6 is pivoted to an open position, as illustrated in FIG. 12, by applying pressure to the lid depression 10. The container with dual dispensers 1 of this embodiment includes a similarly-constructed bottom dispenser characterized by a bottom lid 13, illustrated in phantom in FIG. 9, which corresponds to the top lid 6 of the top dispenser.

It will be appreciated by those skilled in the art that in all of the embodiments described above, the container with dual dispensers of this invention facilitates ease of dispensing container contents by providing a dispensing apparatus or spigot at both ends of the container, so that if one dispenser becomes plugged, the other spigot can be used to dispense the container contents. Furthermore, the respective containers 1 can be constructed to be self-supporting on both ends and of such materials as hard or soft plastic, glass and other materials known to those skilled in the art. In a most preferred embodiment the containers 1 are constructed of plastic to facilitate ease of construction at minimum expense.

The respective containers are rendered much more efficient than predessor receptacles, since the container contents are more easily discharged by entrance of air into the container through one dispenser, while allowing the contents to discharge through the other. Ease of dispensing such materials as hand cream, shampoo, syrup, catsup, barbeque sauce, salad dressing and any flowable liquid is facilitated by the option of using either one of two dispensing spouts or spigots, especially under circumstances where one spout or spigot becomes plugged. The dual dispensers also facilitate substantially complete drainage of the container contents without the necessity of propping the container in its top when the contents are almost exhausted.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A container comprising a generally rectangular body portion for containing a liquid; a container bottom having a bottom recess and a bottom access opening provided in said bottom recess mounted in a bottom end of said body portion and a bottom lid hingedly connected in transverse orientation to said container bottom at substantially the midpoint of said container bottom for selectively sealing said bottom access opening, wherein said bottom lid is seated in said bottom recess when said bottom lid is in sealing configuration; a generally rectangular closure friction-fitted on an upper end of said body portion, a closure top having a closure recess and a closure access opening provided in said closure recess mounted on said closure and a top lid hingedly connected in transverse orientation to said closure top at substantially the midpoint of said closure top for selectively sealing said closure access opening, wherein said top lid is seated in said closure recess when said top lid is in sealing configuration.

2. A container with dual dispensers comprising a flexible, generally hexagonal body portion for enclosing a supply of liquid; a recessed container bottom having a bottom access opening provided in said body portion and defining a bottom lid recess; a generally hexagonal bottom lid having a bottom lid dispensing opening pivotally mounted in said bottom lid recess, wherein said bottom lid dispensing opening communicates with said bottom access opening; a generally hexagonal closure friction-fitted on the upper end of said body portion, a recessed closure top having a closure access opening provided in said closure and defining a top lid recess and a generally hexagonal top lid having a top lid dispensing opening pivotally mounted in said top lid recess, wherein said top lid dispensing opening communicates with said closure access opening, whereby the liquid is maintained in said body portion when said bottom lid and said top lid are pivoted into a closed configuration in said bottom lid recess and said top lid recess, respectively, and the liquid may be selectively dispensed from said body portion through either of said bottom lid dispensing opening and said top lid dispensing opening of said container when one of said bottom lid and said top lid, respectively, is pivoted into an open configuration with respect to said bottom lid recess and said top lid recess, respectively.

3. A dual dispensing container comprising a flexible, generally cylindrical plastic body portion for enclosing a supply of liquid; a plastic bottom end portion closing the bottom end of said body portion; a substantially rectangular bottom spout recess formed radially in said bottom end portion; an elongated, substantially rectangular bottom spout having a bottom spout bore pivotally extendible from said bottom spout recess; a generally cylindrical closure having a substantially rectangular closure spout recess radially formed in said closure friction-fitted on the upper end of said body portion; and an elongated, substantially rectangular closure spout having a closure spout bore pivotally extendible from said closure spout recess, whereby the liquid is maintained in said container when said bottom spout and said closure spout are pivoted into a closed configuration into said bottom spout recess and said closure spout recess, respectively, and the liquid may be selectively dispensed from said body portion through one of said bottom spout and said closure spout when one of said bottom spout and said closure spout, respectively, is selectively pivoted into an open configuration with respect to said bottom spout recess and said closure spout recess, respectively.

* * * * *